US008827179B2

(12) United States Patent
Arik et al.

(10) Patent No.: US 8,827,179 B2
(45) **Date of Patent: *Sep. 9, 2014**

(54) SYSTEM AND METHOD FOR MOUNTING SYNTHETIC JETS

(75) Inventors: Mehmet Arik, Niskayuna, NY (US); William Edward Burdick, Jr., Niskayuna, NY (US)

(73) Assignee: General Electric Company, Schenectady, NY (US)

( * ) Notice: Subject to any disclaimer, the term of this patent is extended or adjusted under 35 U.S.C. 154(b) by 161 days.

This patent is subject to a terminal disclaimer.

(21) Appl. No.: 13/253,356

(22) Filed: Oct. 5, 2011

(65) Prior Publication Data

US 2012/0018537 A1 Jan. 26, 2012

Related U.S. Application Data

(63) Continuation of application No. 12/198,301, filed on Aug. 26, 2008, now Pat. No. 8,083,157.

(51) Int. Cl.

| | |
|---|---|
| ***B05B 1/08*** | (2006.01) |
| ***F04B 43/04*** | (2006.01) |
| ***F04B 17/00*** | (2006.01) |
| ***F23D 14/48*** | (2006.01) |

(52) U.S. Cl.

CPC ..... *F04B 43/046* (2013.01); *F04B 17/003* (2013.01); *F23D 14/48* (2013.01); *F23D 2900/14482* (2013.01)

USPC ..... 239/102.2; 239/102.1

(58) Field of Classification Search

CPC ..... F04B 43/046; F04B 17/003

USPC ..... 239/4, 102.1, 102.2; 128/200.16, 128/200.22; 417/322

See application file for complete search history.

(56) References Cited

U.S. PATENT DOCUMENTS

| | | | |
|---|---|---|---|
| 5,758,823 | A | 6/1998 | Glezer et al. |
| 5,894,990 | A | 4/1999 | Glezer et al. |
| 5,988,522 | A | 11/1999 | Glezer et al. |
| 6,056,204 | A | 5/2000 | Glezer et al. |
| 6,123,145 | A | 9/2000 | Glezer et al. |
| 6,722,581 | B2 | 4/2004 | Saddoughi |
| 6,801,430 | B1 | 10/2004 | Pokharna |

(Continued)

OTHER PUBLICATIONS

Arik, "An investigation into feasibility of impingement heat transfer and acoustic abatement of meso scale synthetic jets," Applied Thermal Engineering, 2007, vol. 27, pp. 1483-1494.

Utturkar et al., "An Experimental and Computational Heat Transfer Study of Pulsating Jets," Journal of Heat Transfer, Jun. 2008, vol. 130, pp. 1-10.

Garg et al., "Meso Scale Pulsating Jets for Electronics Cooling", pp. 1-25.

*Primary Examiner* — Jason Boeckmann

(74) *Attorney, Agent, or Firm* — Ziolkowski Patent Solutions Group, SC; Jean K. Testa

(57) ABSTRACT

A synthetic jet actuator includes a first plate, a second plate spaced apart from the first plate and arranged parallelly thereto, and a housing positioned about the first and second plates and defining a chamber, the housing having a pair of orifices formed therein in opposing sides of the housing such that the chamber is in fluid communication with an external environment. The synthetic jet actuator also includes a mounting mechanism configured to mount the first and second plates within the housing in a suspended arrangement and an actuator element coupled to at least one of the first and second plates to selectively cause deflection thereof, thereby changing a volume within the chamber so that a series of fluid vortices are generated and projected to the external environment out from the pair of orifices of the housing.

18 Claims, 3 Drawing Sheets

(56) References Cited

U.S. PATENT DOCUMENTS

| | | | | |
|---|---|---|---|---|
| 7,263,837 | B2 | 9/2007 | Smith | |
| 8,006,917 | B2 | 8/2011 | Arik et al. | |
| 2004/0069864 | A1 * | 4/2004 | Peng et al. | 239/102.2 |
| 2006/0185822 | A1 * | 8/2006 | Glezer et al. | 165/80.3 |
| 2006/0281398 | A1 | 12/2006 | Yokomizo et al. | |
| 2008/0174620 | A1 * | 7/2008 | Tanner | 347/10 |
| 2010/0053891 | A1 | 3/2010 | Arik et al. | |
| 2010/0054973 | A1 | 3/2010 | Arik et al. | |

* cited by examiner

SYSTEM AND METHOD FOR MOUNTING SYNTHETIC JETS

CROSS-REFERENCE TO RELATED APPLICATION

The present application is a continuation of and claims priority to U.S. patent application Ser. No. 12/198,301 filed Aug. 26, 2008, the disclosure of which is incorporated herein.

BACKGROUND OF THE INVENTION

Embodiments of the invention relate generally to synthetic jet actuators and, more particularly, to the packaging of synthetic jet actuators.

Synthetic jet actuators are a widely-used technology that generates a synthetic jet of fluid to influence the flow of that fluid over a surface. A typical synthetic jet actuator comprises a housing defining an internal chamber. An orifice is present in a wall of the housing. The actuator further includes a mechanism in or about the housing for periodically changing the volume within the internal chamber so that a series of fluid vortices are generated and projected in an external environment out from the orifice of the housing. Examples of volume changing mechanisms may include, for example, a piston positioned in the jet housing to move fluid in and out of the orifice during reciprocation of the piston or a flexible diaphragm as a wall of the housing. The flexible diaphragm is typically actuated by a piezoelectric actuator or other appropriate means.

Typically, a control system is used to create time-harmonic motion of the volume changing mechanism. As the mechanism decreases the chamber volume, fluid is ejected from the chamber through the orifice. As the fluid passes through the orifice, sharp edges of the orifice separate the flow to create vortex sheets that roll up into vortices. These vortices move away from the edges of the orifice under their own self-induced velocity. As the mechanism increases the chamber volume, ambient fluid is drawn into the chamber from large distances from the orifice. Since the vortices have already moved away from the edges of the orifice, they are not affected by the ambient fluid entering into the chamber. As the vortices travel away from the orifice, they synthesize a jet of fluid, i.e., a "synthetic jet."

Due to their inclusion of flexible diaphragms piezoelectric actuator elements, it is recognized that synthetic jet actuators are fragile mechanisms. As synthetic jet actuators can be subjected to a range of environment conditions during use, this can lead to occurrences of pre-mature failure and to the need for replacement of the synthetic jet actuators. Such replacement of the synthetic jet actuators can be time consuming and, in some cases, can also necessitate shutdown of the system or components to which the synthetic jet actuators are designed to provide cooling to. It would thus be beneficial for the synthetic jet actuator be protected from the surrounding environment such that the synthetic jet actuator may be protected from temperature extremes, moisture, and physical impact from surrounding components.

Accordingly, there is a need for a system and method for packaging synthetic jet actuators so as to provide protection from environmental conditions. There is a further need for such a system to have minimal impact on the operation and performance of the synthetic jet actuators.

BRIEF DESCRIPTION OF THE INVENTION

Embodiments of the invention overcome the aforementioned drawbacks by providing a system and method for packaging synthetic jet actuators. Synthetic jet plates and actuator elements of the synthetic jet actuator are mounted within an outer housing in a suspended arrangement such that the housing has a minimal impact on the operation and performance of the synthetic jet actuator.

In accordance with one aspect of the invention, a synthetic jet actuator includes a first plate, a second plate spaced apart from the first plate and arranged parallelly thereto, and a housing positioned about the first and second plates and defining a chamber, the housing having at least one orifice therein such that the chamber is in fluid communication with an external environment. The synthetic jet actuator also includes a mounting mechanism configured to mount the first and second plates within the housing in a suspended arrangement and an actuator element coupled to at least one of the first and second plates to selectively cause deflection thereof, thereby changing a volume within the chamber so that a series of fluid vortices are generated and projected to the external environment out from the at least one orifice of the housing.

In accordance with another aspect of the invention, a method of manufacturing a synthetic jet actuator includes providing an outer housing having a plurality of walls defining a chamber and having an orifice formed in at least one of the plurality of walls and positioning a pair of synthetic jet plates within the outer housing and on opposite ends thereof. The method also includes attaching the pair of synthetic jet plates to the outer housing such that the pair of synthetic jet plates are spaced apart from each of the plurality of walls.

In accordance with yet another aspect of the invention, a synthetic jet actuator includes an outer housing defining a chamber and having at least one opening formed therein and a pair of synthetic jet plates positioned within the outer housing and on opposing sides thereof. The synthetic jet actuator also includes a mounting device configured to affix the pair of synthetic jet plates to the outer housing such that the pair of synthetic jet plates are inwardly spaced from the outer housing so as not to be in contact therewith and at least one actuator element coupled to the pair of synthetic jet plates to selectively change a volume within the chamber so that a series of fluid vortices are generated and projected to an external environment out from the at least one opening in the outer housing.

These and other advantages and features will be more readily understood from the following detailed description of preferred embodiments of the invention that is provided in connection with the accompanying drawings.

BRIEF DESCRIPTION OF THE DRAWINGS

The drawings illustrate embodiments presently contemplated for carrying out the invention.

In the drawings.

DETAILED DESCRIPTION OF THE PREFERRED EMBODIMENT

The present invention provides for a system and method of providing a packaged synthetic jet actuator. The packaged synthetic jet actuator includes an outer housing that surrounds synthetic jet plates and actuator elements, which are mounted to the housing in a suspended arrangement.

Figure 1:
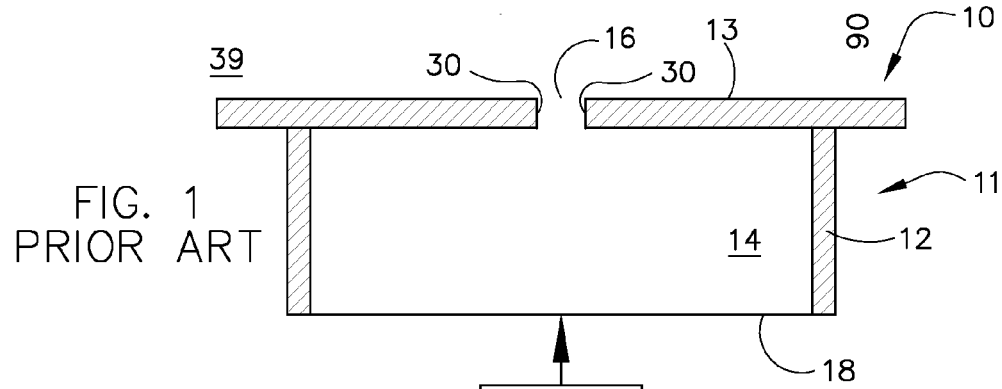
FIG. 1 PRIOR ART
FIG. 1 is a cross-section of a prior art zero net mass flux synthetic jet actuator with a control system.
Figure 2:
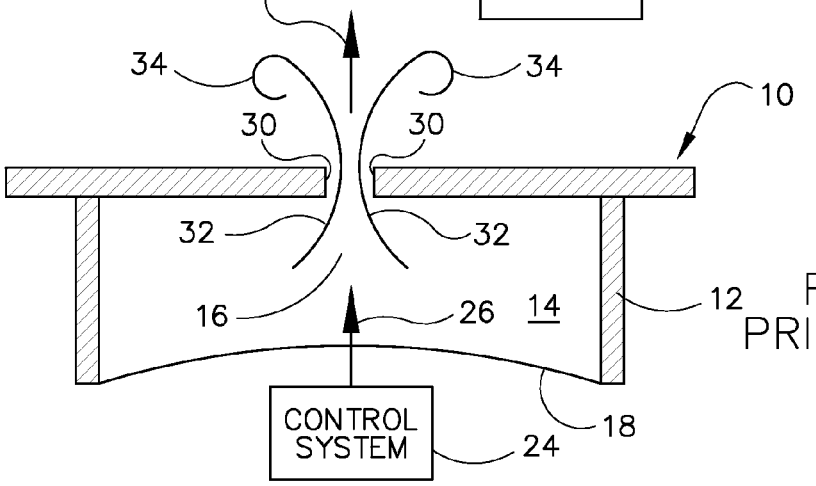
FIG. 2 PRIOR ART
FIG. 2 is a cross-section of the synthetic jet actuator of FIG. 1 depicting the jet as the control system causes the diaphragm to travel inward, toward the orifice.
Figure 3:
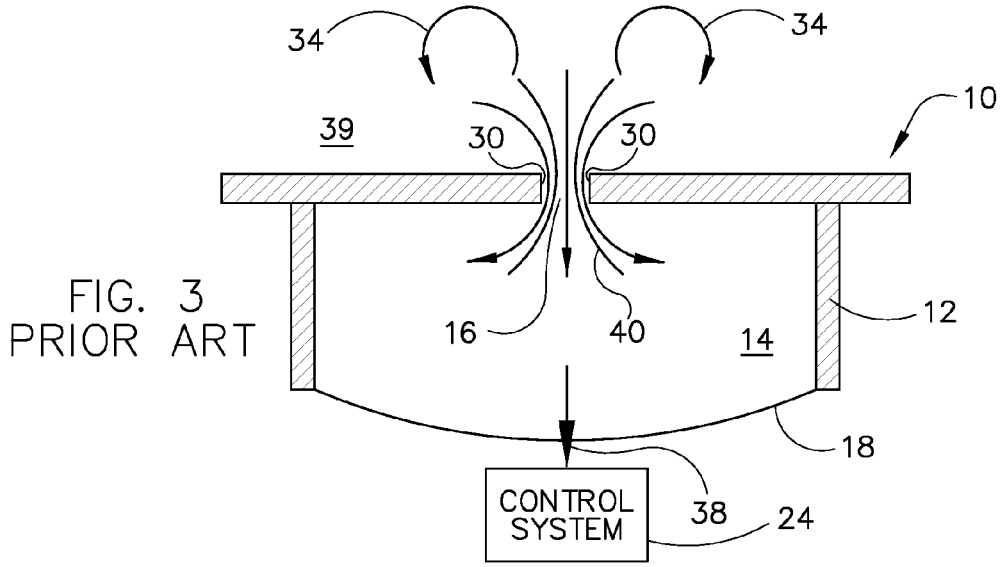
FIG. 3 PRIOR ART
FIG. 3 is a cross-section of the synthetic jet actuator of FIG. 1 depicting the jet as the control system causes the diaphragm to travel outward, away from the orifice.

Referring to FIGS. 1-3, a synthetic jet actuator 10 as known in the art, and the operation thereof, is shown for purposes of describing the general operation of a synthetic jet actuator. The synthetic jet actuator 10 includes a housing 11 defining and enclosing an internal chamber 14. The housing 11 and chamber 14 can take virtually any geometric configuration, but for purposes of discussion and understanding, the housing 11 is shown in cross-section in FIG. 1 to have a rigid side wall 12, a rigid front wall 13, and a rear diaphragm 18 that is flexible to an extent to permit movement of the diaphragm 18 inwardly and outwardly relative to the chamber 14. The front wall 13 has an orifice 16 of any geometric shape. The orifice diametrically opposes the rear diaphragm 18 and connects the internal chamber 14 to an external environment having ambient fluid 39.

The flexible diaphragm 18 may be controlled to move by any suitable control system 24. For example, the diaphragm 18 may be equipped with a metal layer, and a metal electrode may be disposed adjacent to but spaced from the metal layer so that the diaphragm 18 can be moved via an electrical bias imposed between the electrode and the metal layer. Moreover, the generation of the electrical bias can be controlled by any suitable device, for example but not limited to, a computer, logic processor, or signal generator. The control system 24 can cause the diaphragm 18 to move periodically, or modulate in time-harmonic motion, and force fluid in and out of the orifice 16. Alternatively, a piezoelectric actuator could be attached to the diaphragm 18. The control system would, in that case, cause the piezoelectric actuator to vibrate and thereby move the diaphragm 18 in time-harmonic motion.

The operation of the synthetic jet actuator 10 is described with reference to FIGS. 2 and 3. FIG. 2 depicts the synthetic jet actuator 10 as the diaphragm 18 is controlled to move inward into the chamber 14, as depicted by arrow 26. The chamber 14 has its volume decreased and fluid is ejected through the orifice 16. As the fluid exits the chamber 14 through the orifice 16, the flow separates at sharp orifice edges 30 and creates vortex sheets 32 which roll into vortices 34 and begin to move away from the orifice edges 30 in the direction indicated by arrow 36.

FIG. 3 depicts the synthetic jet actuator 10 as the diaphragm 18 is controlled to move outward with respect to the chamber 14, as depicted by arrow 38. The chamber 14 has its volume increased and ambient fluid 39 rushes into the chamber 14 as depicted by the set of arrows 40. The diaphragm 18 is controlled by the control system 24 so that when the diaphragm 18 moves away from the chamber 14, the vortices 34 are already removed from the orifice edges 30 and thus are not affected by the ambient fluid 39 being drawn into the chamber 14. Meanwhile, a jet of ambient fluid 39 is synthesized by the vortices 34 creating strong entrainment of ambient fluid drawn from large distances away from the orifice 16.

It is recognized that synthetic jet actuators, such as the actuator set forth above, can be subjected to a range of environment conditions during use. In some instances, it is desired that the synthetic jet actuator be protected from the surrounding environment, so as to be protected from temperature extremes, moisture, and physical forces/impacts from surrounding components. As such, it is desired that the synthetic jet actuator be "packaged" in a housing-type structure, such as a cover positioned over piezoelectric elements in the synthetic jet actuator.

Figure 4:
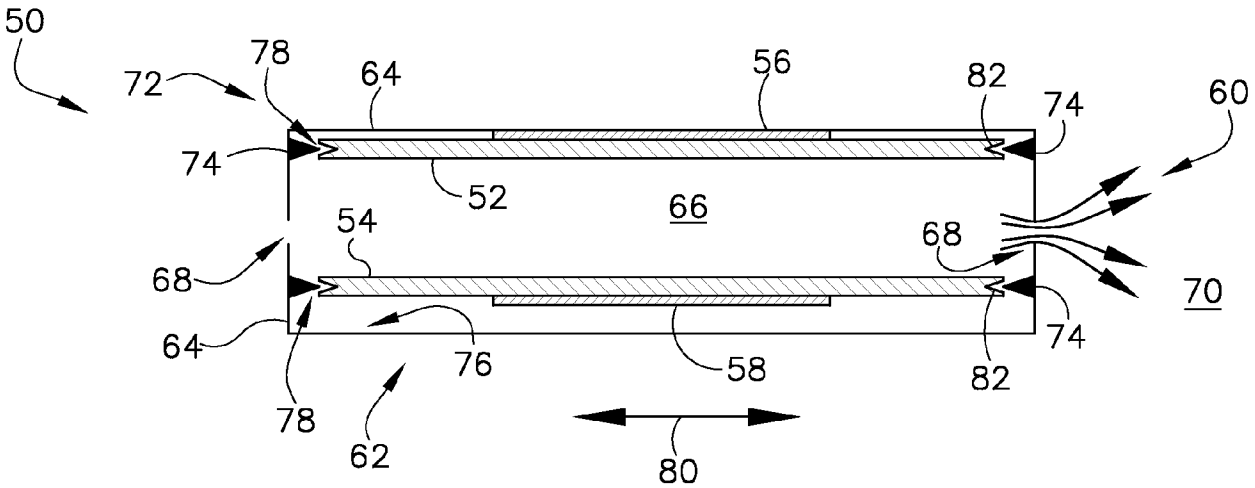
FIG. 4 is a schematic cross-sectional side view of a synthetic jet actuator according to an embodiment of the invention.

Referring now to FIG. 4, according to an embodiment of the invention a synthetic jet actuator 50 is shown. The synthetic jet actuator includes a pair of synthetic jet plates 52, 54, shown in FIG. 4 as a first plate 52 and an opposing second plate 54 arranged parallel thereto. Attached to at least one of the first and second plates 52, 54, or to both of the first and second plates as shown in FIG. 4, are actuator elements 56, 58 configured to cause displacement of the plates. In an exemplary embodiment, actuator elements 56, 58 comprise piezoelectric elements (e.g., piezoelectric disks) that are configured to periodically receive an electric charge from a controller/power source (not shown), and undergo mechanical stress and/or strain responsive to the charge. The stress/strain of piezoelectric elements 56, 58 causes deflection of first and second plates 52, 54 such that, for example, a time-harmonic motion or vibration of the plates is achieved. It is recognized that the piezoelectric elements 56, 58 coupled to the first and second plates 52, 54, respectively, can be selectively controlled to cause vibration of one or both of the plates so as to control the volume and velocity of a synthetic jet stream 60 expelled from the synthetic jet actuator 50.

The first and second plates 52, 54 and actuator elements 56, 58 are positioned within an outer housing 62 having a plurality of walls 64 that surround the first and second plates 52, 54 and define a chamber or volume 66 within the synthetic jet actuator 50. The outer housing 62 includes therein one or more orifices 68 to place the chamber 66 within outer housing 62 in fluid communication with a surrounding, external environment 70. As shown in FIG. 4, a pair of orifices 68 is formed in outer housing 62 to allow for the drawing in and exhaustion of an ambient fluid into and out of the synthetic jet actuator 50. That is, as set forth above, the piezoelectric elements 56, 58 coupled to the first and second plates 52, 54 are selectively controlled to cause vibration of one or both of the plates so as to control the volume and velocity of synthetic jet stream 60 expelled from one or both of the orifices 68.

As shown in FIG. 4, the synthetic jet actuator 50 is secured within the housing by way of a mounting device 72. In the embodiment, mounting device 72 comprises a plurality of point-contact mounts 74 affixed to an internal surface 76 of the housing 62 and extending inwardly therefrom. The point-contact mounts 74 are configured to attach to end surfaces 78 of the first and second plates 52, 54 so as to secure the plates within outer housing 62 and prevent movement. That is, in one embodiment, point-contact mounts 74 are positioned so as to attach to the short end surfaces 78 of the rectangular shaped first and second plates 52, 54. In an exemplary configuration, point-contact holders 74 are configured as V-shaped holders (i.e., chevron-type holders). A pair of V-shaped holders 74 that are linearly aligned in a lengthwise direction 80 of the outer housing 62 are used to secure each of the first and second plates 52, 54. As shown in FIG. 4, a pair of linearly aligned V-shape holders 74 is positioned on each side of the orifice(s) 68 in the outer housing 62 such that first and second plates 52, 54 can be mounted on opposite sides of the orifice(s) 68. To provide for a secure engagement between the V-shaped holders 74 and the first and second plates 52, 54, short end surfaces 78 of each of the first and second plates 52, 54 can include therein a V-shaped notch 82 that is configured to interfit with the V-shaped holders 74. An adhesive 83 can be added between the notch 82 and V-shaped holder 74 to provide for a more secure bonding. Additionally, the adhesive 83 could have a coefficient of thermal expansion (CTE) between that of the material forming the V-shaped holders 74 and the material forming plates 52, 54. Alternative to having a notch 82 formed in plates 52, 54, it is recognized that an interference fit could be formed between V-shaped holders 74 and end surfaces 78 of the plates 52, 54 to secure the plates within housing 62.

Beneficially, V-shaped holders 74 secure first and second plates 52, 54 within outer housing 62 in a manner that allows for unimpeded performance of the synthetic jet actuator 50. That is, as the pair of V-shaped holders 74 used to secure first and second plates 52, 54 are attached to/interfit with short end surfaces 78 of the plates, the V-shaped holders 74 allow for interference-free deflection of the first and second plates 52, 54. Additionally, as the V-shaped holders 74 hold the first and second plates 52, 54 in a "suspended" arrangement in which the plates are spaced apart from the housing 62, no contact is made between the first and second plates 52, 54 and the housing 62 during deflection of the plates induced by actuator elements 56, 58. This lack of contact between plates 52, 54 and housing 62 allows the plates to vibrate at their natural frequency and reduce noise generated by the synthetic jet actuator 50.

Figure 5:
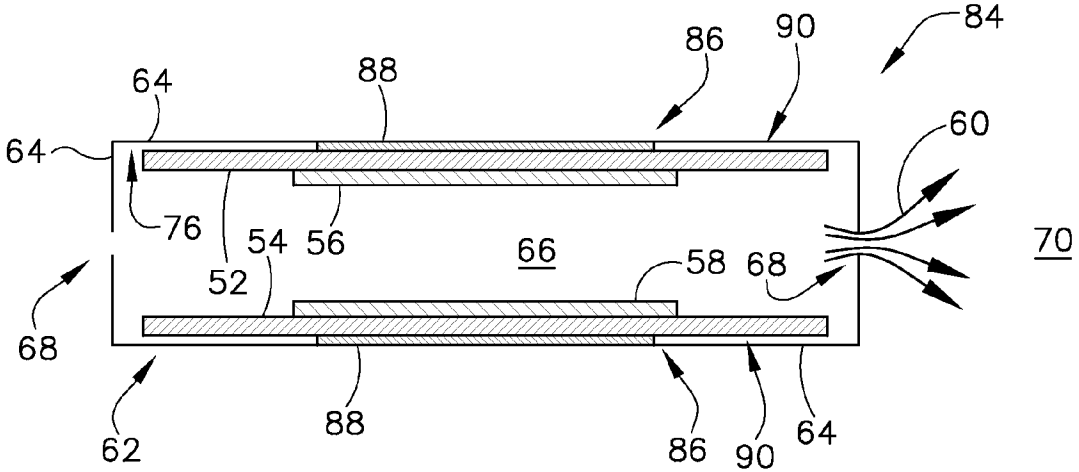
FIG. 5 is a schematic cross-sectional side view of a synthetic jet actuator according to another embodiment of the invention.

Referring now to FIG. 5, a synthetic jet actuator 84 is shown according to another embodiment of the invention. The synthetic jet actuator 84 includes a first synthetic jet plate 52 and an opposing second synthetic jet plate 54 arranged parallel thereto. Attached to at least one of the first and second plates 52, 54, or to both of the first and second plates as shown in FIG. 5, are actuator elements 56, 58 configured to cause displacement of the plates. In an exemplary embodiment, actuator elements 56, 58 comprise piezoelectric elements (e.g., piezoelectric disks) that are configured to periodically receive an electric charge from a controller/power source (not shown), and undergo mechanical stress and/or strain responsive to the charge. The stress/strain of piezoelectric elements 56, 58 causes deflection of first and second plates 52, 54 such that, for example, a time-harmonic motion or vibration of the plates is achieved. It is recognized that the piezoelectric elements 56, 58 coupled to the first and second plates 52, 54, respectively, can be selectively controlled to cause vibration of one or both of the plates so as to control the volume and velocity of a synthetic jet stream 60 expelled from the synthetic jet actuator 84.

The first and second plates 52, 54 and actuator elements 56, 58 are positioned within an outer housing 62 having a plurality of walls 64 that surround the first and second plates 52, 54 and define a chamber or volume 66 within the synthetic jet actuator 84. The outer housing 62 includes therein one or more orifices 68 to place the chamber 66 within outer housing 62 in fluid communication with a surrounding, external environment 70. As shown in FIG. 5, a pair of orifices 68 is formed in outer housing 62 to allow for the drawing in and exhaustion of an ambient fluid into and out of the synthetic jet actuator 84. That is, as set forth above, the piezoelectric elements 56, 58 coupled to the first and second plates 52, 54 are selectively controlled to cause vibration of one or both of the plates so as to control the volume and velocity of synthetic jet stream 60 expelled from one or both of the orifices 68.

The synthetic jet actuator 84 is secured within the housing 62 by way of a mounting device 86. In the embodiment of the invention shown in FIG. 5, mounting device 86 comprises an adhesive 88 applied to opposing internal surfaces 76 of the outer housing 62. Outward facing surfaces 90 (i.e., back surfaces) of the first and second plates 52, 54 are pressed onto the adhesive 88 such that the plates are secured within outer housing 62 and prevented from moving. As shown in FIG. 5, adhesive 88 acts to space first and second plates 52, 54 apart from the housing 62 in a "suspended" arrangement, such that no contact is made between the first and second plates 52, 54 and the housing 62 during deflection of the plates induced by actuator elements 56, 58, thus allows the plates to vibrate at their natural frequency and reduce noise generated by the synthetic jet actuator 84. Additionally, adhesive 88 is applied such that it covers only a portion of the back surface 90 of first and second plates 52, 54 and is formed as a flexible adhesive so as to allow for interference-free deflection of the first and second plates 52, 54. While shown as a continuous section of adhesive 88 in FIG. 5, it is also recognized that the adhesive could be in the form of a post or posts (i.e. discrete attach points vs. a continuous line of adhesive) or other suitable configurations. The exact configuration/shape of the applied adhesive 88 could be determined based on materials, frequency of operation of the synthetic jet actuator, manufacturability, and other factors.

Figure 6:
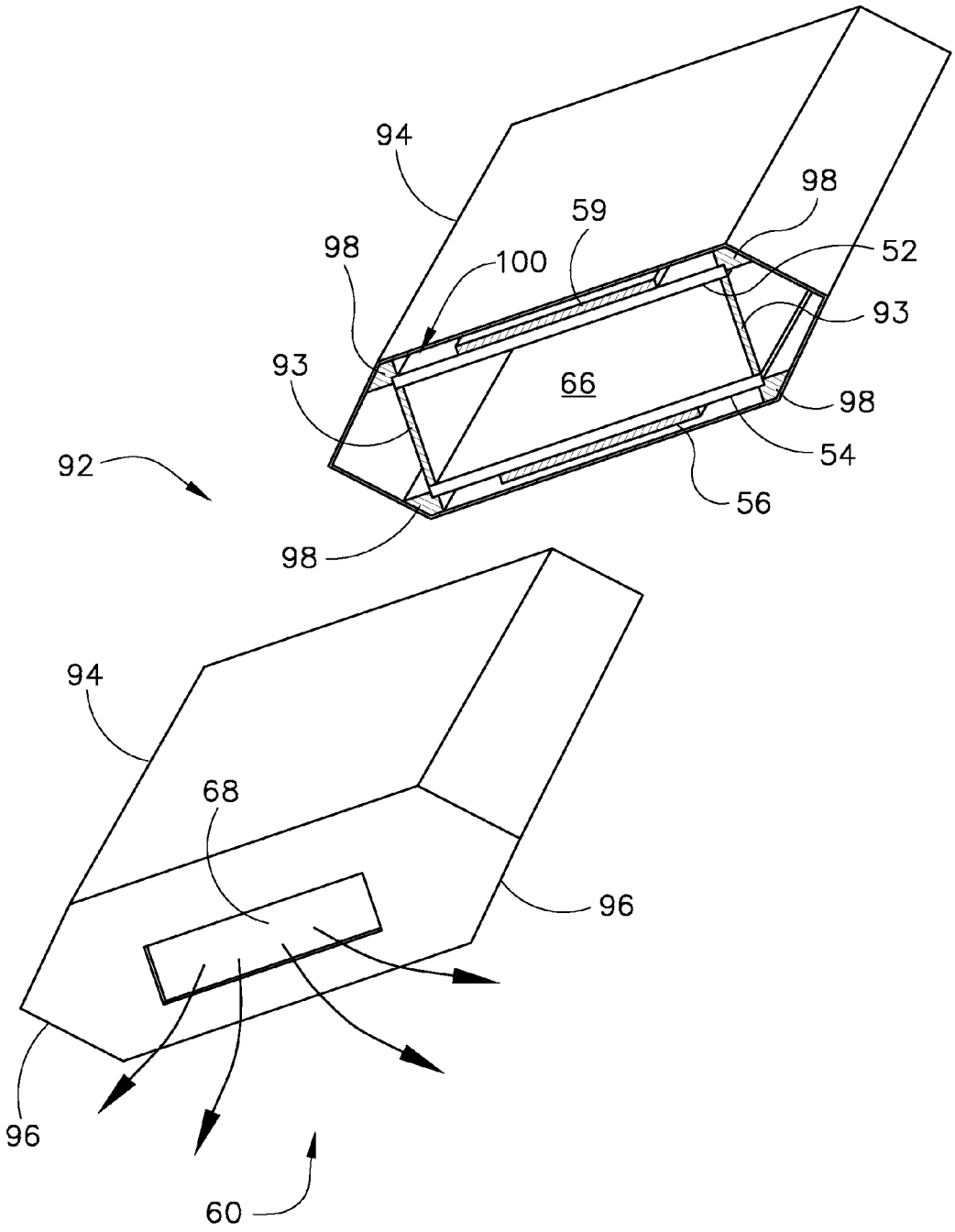
FIG. 6 is an exploded perspective view of a synthetic jet actuator according to another embodiment of the invention.

Another embodiment of the invention, is shown in FIG. 6 and shows a synthetic jet actuator 92 having first and second synthetic jet plate 52, 54 spaced apart by a flexible support structure 93 (i.e., wall or posts). Attached to at least one of the first and second plates 52, 54, or to both of the first and second plates as shown in FIG. 6, are actuator elements 56, 58 configured to cause displacement of the plates. It is recognized that the actuator elements 56, 58 coupled to the first and second plates 52, 54, respectively, can be selectively controlled to cause vibration of one or both of the plates so as to control the volume and velocity of a synthetic jet stream 60 expelled from the synthetic jet actuator 92.

The first and second plates 52, 54 and actuator elements 56, 58 are positioned within an outer housing 94 that surrounds the first and second plates 52, 54 and define a chamber or volume 66 within the synthetic jet actuator 92. The outer housing 94 includes a pair of V-shaped walls 96 on opposing sides thereof and one or more orifices 68 to place the chamber 66 within outer housing 94 in fluid communication with a surrounding, external environment 70. The synthetic jet actuator 92 is secured within the housing 94 by way of cradles 98 that form a mounting device. Cradles 98 are mounted to an inner surface 100 of the V-shaped walls 96 such that they contact the first and second plates 52, 54. The V-shaped walls 96 allow for the structure formed by first and second plates 52, 54 and support structure 93 to be wedged between the V-shaped walls 96 and supported thereby in a point-contact fashion. This point-contact between plates 52, 54 and housing 94 allows the plates to vibrate at their natural frequency and reduce noise generated by the synthetic jet actuator 92.

As set forth above with respect to FIGS. 4-6, a minimal-contact mounting arrangement of the first and second synthetic jet plates 52, 54 within an outer housing 62, 94 is provided. The housing 62, 94 of synthetic jet actuator 50, 84 provides protection from the surrounding environment 70, such that synthetic jet actuator 50, 84, 92 is protected from temperature extremes, moisture, and physical forces/impact from surrounding components. Additionally, the embodiments set forth above provide for a mounting structure of synthetic jet plates 52, 54 within outer housing 62, 94 that has a minimal impact on performance of the synthetic jet actuator 50, 84, as the suspension mounting arrangement prevents outer housing 62, 94 from interfering with the deflection and vibration of the plates 52, 54 of the synthetic jet actuator.

While the synthetic jet actuators of FIGS. 4-6 are shown/described as having multiple orifices therein forming separate intake and exhaust orifices, it is also envisioned that embodiments of the invention could be used with single orifice synthetic jet actuators. Additionally, while the synthetic jet actuators of FIGS. 4-6 are shown/described as having an actuator element included on each of first and second plates, it is also envisioned that embodiments of the invention could include only a single actuator element positioned on one of the plates. Furthermore, it is also envisioned that the synthetic jet actuators set forth above could be circular/cylindrical in shape and that the synthetic jet plates and actuator elements therein be circular in shape and mount to the housing in one of the manners set forth above, rather than in a rectangular configuration.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

Therefore, according to one embodiment of the invention, a synthetic jet actuator includes a first plate, a second plate spaced apart from the first plate and arranged parallelly thereto, and a housing positioned about the first and second plates and defining a chamber, the housing having at least one orifice therein such that the chamber is in fluid communication with an external environment. The synthetic jet actuator also includes a mounting mechanism configured to mount the first and second plates within the housing in a suspended arrangement and an actuator element coupled to at least one of the first and second plates to selectively cause deflection thereof, thereby changing a volume within the chamber so that a series of fluid vortices are generated and projected to the external environment out from the at least one orifice of the housing.

According to another embodiment of the invention, a method of manufacturing a synthetic jet actuator includes providing an outer housing having a plurality of walls defining a chamber and having an orifice formed in at least one of the plurality of walls and positioning a pair of synthetic jet plates within the outer housing and on opposite ends thereof The method also includes attaching the pair of synthetic jet plates to the outer housing such that the pair of synthetic jet plates are spaced apart from each of the plurality of walls.

According to yet another embodiment of the invention, a synthetic jet actuator includes an outer housing defining a chamber and having at least one opening formed therein and a pair of synthetic jet plates positioned within the outer housing and on opposing sides thereof. The synthetic jet actuator also includes a mounting device configured to affix the pair of synthetic jet plates to the outer housing such that the pair of synthetic jet plates are inwardly spaced from the outer housing so as not to be in contact therewith and at least one actuator element coupled to the pair of synthetic jet plates to selectively change a volume within the chamber so that a series of fluid vortices are generated and projected to an external environment out from the at least one opening in the outer housing.

What is claimed as new and desired to be protected by Letters Patent of the United States is:

1. A synthetic jet actuator comprising:

a first plate;

a second plate spaced apart from the first plate and arranged parallelly thereto;

a housing positioned about the first and second plates and defining a chamber, the housing having a pair of orifices formed therein in opposing sides of the housing such that the chamber is in fluid communication with an external environment;

an adhesive configured to mount the first and second plates within the housing in a suspended arrangement, the adhesive being applied to at least a portion of an outward facing surface of each of the first and second plates; and an actuator element coupled to at least one of the first and second plates to selectively cause deflection thereof, so that fluid vortices are generated and projected to the external environment out from the pair of orifices of the housing in opposite directions;

wherein the adhesive comprises a flexible adhesive configured to allow for interference-free deflection of the first and second plates, such that the first and second plates are allowed to vibrate at their natural frequency so as to reduce noise generated by the synthetic jet actuator.

2. The synthetic jet actuator of claim 1 wherein the first and second plates are spaced apart from the housing in a suspended arrangement such that no contact is made between the first and second plates and the housing.

3. The synthetic jet actuator of claim 1 wherein the mounting mechanism is configured to mount the first and second plates within the housing on opposing sides of the at least one orifice.

4. The synthetic jet actuator of claim 1 wherein the actuator element coupled to at least one of the first and second plates comprises a pair of piezoelectric elements, and wherein each piezoelectric element is attached to a respective plate of the first and second plates to selectively cause deflection thereof.

5. The synthetic jet actuator of claim 1 wherein no contact is made between the first and second plates and the housing during deflection of the plates induced by actuator element.

6. The synthetic jet actuator of claim 1 wherein the adhesive is applied to a middle portion of an outward facing surface of each of the first and second plates, so as to substantially aligned with the actuator element applied to an inward facing surface of each of the first and second plates.

7. A synthetic jet actuator comprising:

a first synthetic jet plate having a surface with an outer portion extending radially outward from an inner portion;

a second synthetic jet plate spaced apart from the first synthetic jet plate and arranged parallelly thereto, the second synthetic jet plate having a surface with an outer portion extending radially outward from an inner portion;

a housing positioned about the first and second synthetic jet plates and defining a chamber, the housing having at least one orifice therein such that the chamber is in fluid communication with an external environment;

an actuator element coupled to at least one of the first and second synthetic jet plates to selectively cause deflection thereof, thereby changing a volume within the chamber so that a series of fluid vortices are generated and projected to the external environment out from the at least one orifice of the housing; and a mounting mechanism configured to mount the first and second plates within the housing in a suspended arrangement such that no contact is made between the first and second plates and the housing during deflection of the plates induced by actuator element;

wherein the mounting mechanism comprises a layer of flexible adhesive applied to the inner portion of the surface of each of the first and second plates, wherein the outer portion of the surface of each of the first and second plates is free of adhesive.

8. The synthetic jet actuator of claim 7 wherein the at least one orifice comprises a pair of orifices formed on opposing sides of the housing.

9. The synthetic jet actuator of claim 7 wherein the first and second plates are spaced apart from the housing in a suspended arrangement such that no contact is made between the first and second plates and the housing.

10. The synthetic jet actuator of claim 7 wherein the mounting mechanism is configured to mount the first and second plates within the housing on opposing sides of the at least one orifice.

11. The synthetic jet actuator of claim 7 wherein the actuator element coupled to at least one of the first and second plates comprises a pair of piezoelectric elements, and wherein each piezoelectric element is attached to a respective plate of the first and second plates to selectively cause deflection thereof.

12. The synthetic jet actuator of claim 7 wherein the layer of flexible adhesive enables the first and second plates to vibrate at natural frequencies when actuated so as to reduce noise generated by the synthetic jet actuator.

13. The synthetic jet actuator of claim 7 wherein the outer portion of the surface each of the first and second plates is cantilevered.

14. A synthetic jet actuator comprising:

an outer housing defining a chamber and having at least one opening formed therein;

first and second synthetic jet plates positioned within the outer housing and on opposing sides thereof;

a mounting device configured to affix the first and second synthetic jet plates to the outer housing such that the first and second synthetic jet plates are inwardly spaced from the outer housing so as not to be in contact therewith; and at least one actuator element coupled to the first and second synthetic jet plates to selectively change a volume within the chamber so that a series of fluid vortices are generated and projected to an external environment out from the at least one opening in the outer housing;

wherein the mounting device comprises:

a continuous layer of adhesive applied to a middle portion of an outward facing surface of each of the first and second synthetic jet plates, such that the adhesive covers a mid-point of the outward facing surface of the first and second synthetic jet plates and such that outer portions of the outward facing surface of the first and second synthetic jet plates are free of adhesive.

15. The synthetic jet actuator of claim 14 wherein the at least one opening comprises a pair of orifices formed on opposing sides of the outer housing.

16. A synthetic jet actuator comprising:

a housing defining a chamber, the housing having at least one orifice therein such that the chamber is in fluid communication with an external environment;

first and second synthetic jet plates positioned within the housing and being spaced apart so as not to be on opposing sides of the housing;

an actuator element coupled to each of the first and second synthetic jet plates to selectively cause deflection thereof; and a mounting mechanism comprising a layer of adhesive applied to a portion of the housing and a point of contact on each of the first and second synthetic jet plates inward from an end thereof, the end cantilevered with respect to the point of contact.

17. The synthetic jet actuator of claim 16 wherein the synthetic jet plate is positioned within the housing in a suspended arrangement such that no contact is made between the synthetic jet plate and the housing during deflection of the plates induced by the actuator element.

18. The synthetic jet actuator of claim 16 wherein the at least one orifice comprises a pair of orifices formed on opposing sides of the housing.

* * * * *